US008807201B2

(12) United States Patent
Franz et al.

(10) Patent No.: US 8,807,201 B2
(45) Date of Patent: Aug. 19, 2014

(54) DEVICE AND METHOD FOR HORIZONTAL CASTING OF A METAL BAND

(75) Inventors: Rolf Franz, Kreuztal (DE); Christian Mengel, Siegen (DE); Olaf Norman Jepsen, Siegen (DE); Karl-Heinz Spitzer, Clausthal-Zellerfeld (DE); Hellfried Eichholz, Ilsede (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 13/380,978

(22) PCT Filed: Jun. 23, 2010

(86) PCT No.: PCT/EP2010/003772
§ 371 (c)(1),
(2), (4) Date: Feb. 13, 2012

(87) PCT Pub. No.: WO2010/149351
PCT Pub. Date: Dec. 29, 2010

(65) Prior Publication Data

US 2012/0132390 A1 May 31, 2012

(30) Foreign Application Priority Data

Jun. 27, 2009 (DE) ..... 10 2009 030 793

(51) Int. Cl.
*B22D 11/045* (2006.01)
*B22D 11/124* (2006.01)

(52) U.S. Cl.
USPC ..... 164/463; 164/429

(58) Field of Classification Search
USPC ..... 164/462, 463, 479, 423, 429
See application file for complete search history.

(56) References Cited

U.S. PATENT DOCUMENTS

| | | | | |
|---|---|---|---|---|
| 3,988,098 | A * | 10/1976 | Kato et al. | 425/224 |
| 4,367,783 | A * | 1/1983 | Wood et al. | 164/452 |
| 4,679,612 | A * | 7/1987 | Artz et al. | 164/431 |
| 4,901,785 | A * | 2/1990 | Dykes et al. | 164/481 |
| 8,047,263 | B2 | 11/2011 | Spitzer et al. | |
| 2010/0132911 | A1 * | 6/2010 | Bausch et al. | 164/463 |
| 2010/0252223 | A1 | 10/2010 | Franz et al. | |
| 2011/0253339 | A1 | 10/2011 | Bausch et al. | |

FOREIGN PATENT DOCUMENTS

| | | |
|---|---|---|
| DE | 102007056192 | 5/2009 |
| JP | 01313157 | 12/1989 |
| WO | 9633826 Y | 3/1998 |
| WO | 2006066552 | 6/2006 |
| WO | 2009018973 | 2/2009 |

OTHER PUBLICATIONS

Schwerdtfeger K et al: "Endabmessungsnahes Vorbandgiessen Von Stahl Mit Dem Belt-Roll-Verfahren", Stahl Und Eisen, Verlag Stahleisen, Dusseldorf, DE, Bd. 111, No. 6, Jun. 14, 1991, pp. 37-43,155, XP000209376.

* cited by examiner

*Primary Examiner* — Kevin P Kerns
(74) *Attorney, Agent, or Firm* — Lucas & Mercanti, LLP; Klaus P. Stoffel

(57) ABSTRACT

A device and a method for horizontal casting of a metal band. The device includes a dispensing vessel for a melt and a cooled conveyor belt disposed downstream of the dispensing vessel in the casting direction running between two deflecting rollers and on which the metal band can be transported. The device further includes at least one roller that can be engaged with the metal band for profiling. Early and therefore improved influence on the profile of a metal band, that is the leader band, is thereby made possible.

21 Claims, 1 Drawing Sheet

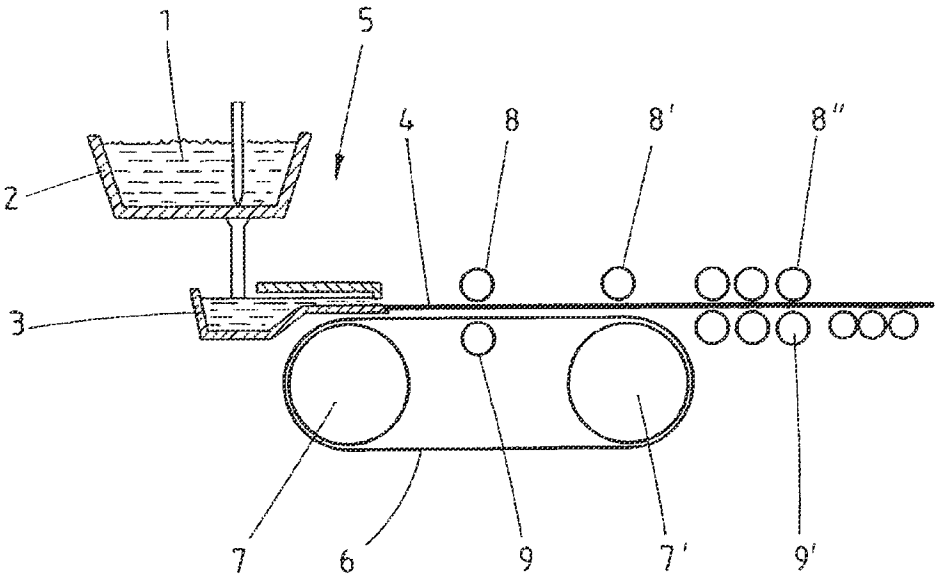
1
2
3
4
5
6
7
7'
8
8'
8''
9
9'

DEVICE AND METHOD FOR HORIZONTAL CASTING OF A METAL BAND

The present application is a 371 of International application PCT/EP2010/003772, filed Jun. 23, 2010, which claims priority of DE 10 2009 030 793.1, filed Jun. 27, 2009, the priority of these applications is hereby claimed and these applications are incorporated herein by reference.

BACKGROUND OF THE INVENTION

The invention falls within the field of horizontal strip casting. In this process, a molten metal is fed from a feed vessel onto a cooled conveyor belt, on which it starts to solidify into a strip.

PRIOR ART

Horizontal strip casting methods and installations are known from the prior art. In these prior-art methods and installations, the cast product or the already solidified metal strip passes through additional processing steps, for example, a rolling process. One of the characteristics of the steel strip produced in this way is the profile or thickness profile (camber), i.e., the variation in strip thickness over the width of the strip. The near-net strip profile that developed during the casting process can be influenced only to a limited extent and with considerable difficulty during the subsequent rolling process. The reason is often related to the relatively thin strip cross sections. In this case, profiling and flatness are dependent on each other, since the transverse material flow necessary for changing the profile is limited.

WO 2006/066552 A1 discloses a horizontal steel strip casting installation of this type, in which the molten metal is fed onto a conveyor belt, which forms a cooling zone. This cooling zone is followed by a second temperature control zone. Depending on the temperature control program, as the strip enters the second zone, it is already completely solidified. At this point, upward bending of the edges can develop, which can have negative effects on the casting process. The cited document specifies equipment in the form of, for example, roll pairs, that counteract this effect and press the strip down. However, no provision is made here for controlling the thickness profile. The thickness profile of the near-net strip is determined in the casting process and, depending on the boundary conditions, can no longer be adequately controlled in a subsequent rolling process. This problem arises especially, but not exclusively, in thin-strip casting processes, in which a strip with a thickness of less than 40 mm is cast. Critical thickness profiles can be, for example, profiles with a wedge component or also with a waviness with a quadratic or higher-order component. The expert is familiar with these kinds of critical profiles.

The document WO 2009/018973 A1 discloses a similar installation, in which flattening rolls or driving rolls are arranged, in the direction of casting, downstream of a conveyor belt and above a deflection pulley of the conveyor belt. The rolls disclosed in the cited document likewise have no ability to control the thickness profile of the metal strip. It is only possible to prevent upward bending of the strip edges, which indeed is the stated objective of the roll arrangement disclosed in this document. The profile or thickness profile, i.e., the thickness variation of the strip in the width direction of the strip, cannot be appreciably influenced.

In general, efforts to influence the thickness profile of a metal strip should be made as early as possible, especially at the highest possible temperatures, i.e., especially at low strength values of the metal strip, since the conditions for transverse material flow improve when the strength is low, i.e., the temperature is high. In this connection, the possibility of deformation of the strip material is limited by the ductility of the material, i.e., by the ability of the material to be deformed without mechanical damage, for example, cracking, which decreases with increasing temperature.

Consequently, the principal technical objective is to create a device and a method that make it possible to influence the thickness profile of a metal strip as early as possible.

SUMMARY OF THE INVENTION

The present invention achieves the aforementioned technical objective and comprises, first of all, a device for the horizontal casting of a metal strip, which in turn comprises a feed vessel for a melt and a cooled conveyor belt, which is arranged downstream of the feed vessel in the direction of casting, which runs between two deflection pulleys, and on which the metal strip can be conveyed, such that the device has at least one adjustable roll that can be set on the metal strip to profile it.

The device designed in accordance with the invention now makes it possible to influence the thickness profile of the metal strip at a very early point in time and thus greatly improve the shape and quality of the cast product. In any case, it is now possible for subsequent rolling processes to achieve a predetermined profile or a predetermined flatness.

In a preferred embodiment of the device, the one or more adjustable rolls that can be set on the metal strip to profile it are arranged in the area between the deflection pulleys and/or above one of the deflection pulleys.

This arrangement of the rolls makes it possible to adjust the thickness profile while the strip is still in the area of the conveyor belt.

In another preferred embodiment of the device, several adjustable profiling rolls are arranged above and below the metal strip.

In another preferred embodiment of the device, at least one adjustable upper profiling roll is arranged above the metal strip, and at least one other, lower profiling roll is arranged below the metal strip, so that the one or more upper rolls and the one or more lower rolls form one or more pairs of adjustable profiling rolls.

The formation of one or more pairs of profiling rolls makes it possible to exert systematic influence on the whole thickness profile of the metal strip, specifically, in a plane perpendicular to the direction of casting.

In another preferred embodiment of the device, the conveyor belt forms a first cooling zone, and the device additionally comprises a temperature control zone downstream of the conveyor belt in the casting direction, such that the device has at least one adjustable profiling roll that can be set on the metal strip in this temperature control zone and/or in the cooling zone.

In another preferred embodiment of the device, a roll can be swiveled. This makes it possible to control the thickness taper of the strip.

In another preferred embodiment of the device, the one or more adjustable profiling rolls have a barrel contour and/or are horizontally shiftable and/or can be bent along the longitudinal axis.

If the profiling rolls have a barrel contour, the profile of the strip can be systematically controlled by the cut of the rolls. If the rolls can be horizontally shifted, then, depending on the barrel contour, a thickness profile can be systematically adjusted, and this can be done during the casting process and under varying process conditions (e.g., when there is roll wear). As a result of the fact that the rolls can be bent, the thickness profile can be flexibly adjusted during the casting process and under varying process conditions.

In another preferred embodiment of the device, at least one adjustable lower profiling roll that lies at the pass line height of the metal strip is arranged below the metal strip.

In addition to the device of the invention for the horizontal casting of a metal strip, the invention concerns a method for the horizontal casting of a metal strip, where the method involves the use of a cooled conveyor belt, which is arranged downstream of the feed vessel in the direction of casting, which runs between two deflection pulleys, and on which the metal strip is conveyed, and the use of at least one adjustable roll that can be set on the metal strip to profile it, such that the thickness profile of the metal strip is influenced by the one or more adjustable profiling rolls.

The advantages of the method are largely the same as those of the previously described device of the invention.

In a preferred embodiment of the method, the profiling is carried out in the area between the deflection pulleys or above one of the deflection pulleys.

In another preferred embodiment of the method, the method comprises several adjustable profiling rolls above and below the metal strip, such that the rolls carry out the profiling.

In another preferred embodiment of the method, the conveyor belt forms a cooling zone, and the method additionally comprises a temperature control zone downstream of the conveyor belt in the casting direction, such that the metal strip is influenced by the one or more adjustable profiling rolls in this temperature control zone and/or in the cooling zone.

In another preferred embodiment of the method, the method comprises adjustable profiling rolls with a barrel contour and/or bent rolls and/or rolls that can be horizontally shifted, such that the profiling of the metal strip is influenced by one or more of these rolls.

In another preferred embodiment of the method, the method comprises at least, one adjustable lower profiling roll arranged at the pass line height of the metal strip.

In another preferred embodiment of the method, the one or more adjustable profiling rolls are hydraulically or mechanically set on the metal strip under automatic force control and/or automatic position control.

This makes it possible to set the rolls on the metal strip with a certain force under automatic force control and/or automatic position control and to effect exact profiling or thickness profiling.

In another preferred embodiment of the method, the method constitutes a thin-strip casting method for producing a near-net strip, especially with a thickness of less than 40 mm.

It is precisely in thin-strip casting processes that it is very difficult to influence the profile of a near-net strip after the casting process. Therefore, the method of the invention is especially advantageous in the case of thin-strip casting.

In another preferred embodiment of the method, the one or more adjustable profiling rolls deform the metal strip in such a way that the metallurgical structure of the metal strip is altered.

This means, in other words, that, e.g., recrystallization processes, are initiated.

In another preferred embodiment of the method, surface waviness with a quadratic or higher-order component that develops on the surface of the metal strip is smoothed by the one or more adjustable profiling rolls or the one or more pairs of adjustable profiling rolls.

The drawing of a specific embodiment of the invention is briefly described below. Further details are provided in the detailed description of the specific embodiments.

BRIEF DESCRIPTION OF THE DRAWING

FIG. 1 shows a schematic cross section of an embodiment of a device of the invention, in which a metal strip is horizontally cast and influenced with respect to its profiling by various rolls.

DETAILED DESCRIPTION OF THE INVENTION

FIG. 1 shows a specific embodiment of the invention. In the illustrated horizontal strip casting installation 5, liquid melt 1 is first fed into a feed vessel 3 from a casting ladle/tundish 2. The liquid metal 1 is then fed from the feed vessel 3 onto a conveyor belt 6, which is preferably cooled and forms a cooling zone. The conveyor belt 6 runs around two deflection pulleys 7, 7'. The melt 1 starts to solidify on the conveyor belt 6 to form a metal strip 4. Experts in this field are already familiar with systems and processes of this type. In accordance with the invention, the preferably partially solidified melt 1 that forms the metal strip is influenced with respect to its profiling, i.e., deformed to provide the desired profile, by one or more rolls 8, 8', 8", 9, 9'. The rolls 8, 8', 8", 9, 9' can be set on the metal strip 4 above or below the conveyor belt 6 to provide the desired profiling or may also be set on the metal strip 4 downstream of the conveyor belt 6 in the direction of casting. In this profiling process, the roll 8, 8', 8", 9, 9' preferably exerts a force on the surface of the strip 4. The roll 8, 8', 8", 9, 9' is preferably set under automatic force control and/or automatic position control.

Furthermore, the profiling process can also be associated with a thickness reduction of the metal strip 4.

It should be made clear once again at this time that the profile or thickness profile represents the distribution of the thickness of the metal strip 4 in the direction of the width of the metal strip 4. This term "profile", also called "thickness profile", is not the same thing as, in particular, the term of the same name that is occasionally used in some other writings to describe, for example, a metal strip 4 which is bent on the whole in the width direction, in which, however, there is no profile or thickness profile variation in the proper sense, such as, for example, that of a wedge shape.

As FIG. 1 also shows, the profiling rolls 8, 8', 8", 9, 9' can be arranged especially to form profiling roll pairs 8, 9; 8', 9'. Optionally, it is also possible to arrange several of these roll pairs 8, 9; 8', 9' in the interval between the two deflection pulleys 7, 7' and/or in the area downstream of the right deflection pulley 7' in the direction of casting. In addition, it is also possible for a profiling roll 8" to be arranged directly above one of the deflection pulleys 7, 7', especially above the last (right) deflection pulley 7', as shown in FIG. 1.

Preferably, the section of the device downstream of the conveyor belt 6 can be designed as a temperature control zone, so that in this area the metal strip 4 can either be heated, i.e., for example, held at a certain temperature, or cooled, for example, by spray nozzles. Temperature control zones of this type are already known from the prior art. In particular, in accordance with the invention, the profiling rolls 8', 9' can be set on the metal strip 4 in the area downstream of the conveyor belt 6 even before the metal strip 4 has completely solidified and is still at the highest temperatures possible. Moreover, a number of guide rollers can also be arranged downstream of the conveyor belt 6. This type of arrangement of guide rollers with a different function is also known from the prior art.

All of the rolls 9, 9', which are located below the metal strip 4, can be set against the metal strip 4 in such a way that they have only a guiding function, i.e., they lie at the pass line height of the metal strip 4. However, it is also possible for the rolls 9, 9' as well as the rolls 8, 8', 8" to be set against the metal strip with a contact pressure or force.

Preferably, some or all of the rolls 8, 8', 8", 9, 9' can have a barrel contour.

Preferably, the profiling rolls 8, 8', 8", 9, 9' can also be designed to be horizontally shiftable, especially axially displaceable.

Furthermore, the rolls 8, 8', 8", 9, 9' can also be bent perpendicular to the casting direction by the introduction of force, i.e., bent in their longitudinal direction, so that a variable thickness profile of a metal strip 4 can be produced.

In this connection, the adjustable profiling rolls 8, 8', 8", 9, 9' can be set on the metal strip 4 in such a way that a recrystallization process of the partially solidified metal strip 4 is initiated and the metallurgical structure of the metal strip 4 is altered. In addition, the profiling rolls 8, 8', 8", 9, 9' can be used to smooth surface waviness on the surface of the metal strip 4. Optimum profiling or thickness profiling can thus be realized as a function of the shape of the rolls 8, 8', 8", 9, 9'.

The methods of the invention are preferably, but not exclusively, thin-strip casting methods for producing near-net strip with a thickness especially of less than 40 mm.

All of the features that have been described can be combined with one another in any form that seems technically possible to those skilled in the art, or they can be adapted to specific circumstances or requirements.

LIST OF REFERENCE NUMBERS

1 melt
2 casting ladle/tundish
3 feed vessel
4 metal strip
5 strip casting installation
6 conveyor belt
7, 7' deflection pulleys
8, 8', 8" upper rolls
9, 9' lower rolls

The invention claimed is:

1. A device for horizontal casting of a metal strip, comprising:

a feed vessel for a melt;

two deflection pulleys;

a cooled conveyor belt arranged downstream of the feed vessel in a direction of casting, and arranged to run between the two deflection pulleys, and on which the metal strip is conveyable; and at least one adjustable profiling roll that is set directly in contact with the metal strip for thickness profiling the metal strip, wherein the at least one adjustable profiling roll is arranged in an area between the deflection pulleys.

2. The device in accordance with claim 1, wherein the at least one adjustable profiling roll is also arranged above one of the deflection pulleys.

3. The device in accordance with claim 1, wherein several adjustable profiling rolls are arranged above and below the metal strip.

4. The device in accordance with claim 1, including a plurality of adjustable profiling rolls, the plurality of rolls including at least one adjustable upper profiling roll arranged above the metal strip, and at least one lower profiling roll arranged opposite the upper profiling roll and below the metal strip, so that the at least one upper roll and the at least one lower roll form at least one pair of adjustable profiling rolls.

5. The device in accordance with claim 1, wherein the conveyor belt forms a cooling zone, and further comprising a temperature control zone downstream of the conveyor belt in the casting direction, wherein the at least one adjustable profiling roll is arranged to be settable on the metal strip in the temperature control zone and/or in the cooling zone.

6. The device in accordance with claim 1, wherein the at least one roll is swivelable against the metal strip to profile the metal strip.

7. The device in accordance with claim 1, wherein the at least one adjustable profiling roll has a barrel contour.

8. The device in accordance with claim 1, wherein the at least one adjustable profiling roll is horizontally shiftable.

9. The device in accordance with claim 1, wherein the at least one adjustable profiling roll is bendable along a horizontal axis.

10. The device in accordance with claim 1, wherein at least one adjustable lower profiling roll is arranged below the metal strip and lies at a pass line height of the metal strip.

11. A method for horizontal casting a metal strip, the method comprising the steps of: using a cooled conveyor belt arranged downstream of a feed vessel in a direction of casting, the conveyor belt running between two deflection pulleys and conveying the metal strip; profiling the metal strip with at least one adjustable profiling roll that is set on the metal strip; and influencing a thickness profile of the metal strip by setting the at least one adjustable profiling roll directly in contact with the metal strip in an area between the deflection pulleys.

12. The method in accordance with claim 11, including carrying out the profiling in the area between the deflection pulleys and above one of the deflection pulleys.

13. The method in accordance with claim 11, including carrying out the profiling with several adjustable profiling rolls above and below the metal strip.

14. The method in accordance with claim 11, wherein the conveyor belt forms a cooling zone, the method further comprising arranging a temperature control zone downstream of the conveyor belt in the casting direction, and the influencing the metal strip by the at least one adjustable profiling roll occurring in the temperature control zone and/or in the cooling zone.

15. The method in accordance with claim 11, wherein at least one of the rolls is swivelable, so that thickness taper of the strip is systematically controlled.

16. The method in accordance with claim 11, wherein the at least one adjustable profiling roll includes adjustable profiling rolls with a barrel contour and/or bent rolls and/or horizontally shiftable rolls, so that the profiling of the metal strip is influenced by at least one of the rolls.

17. The method in accordance with claim 11, including arranging at least one adjustable lower profiling roll at a pass line height of the metal strip.

18. The method in accordance with claim 11, including setting the at least one adjustable profiling roll hydraulically or mechanically on the metal strip under automatic force control and/or automatic position control.

19. The method in accordance with claim 11, wherein the method is a thin-strip casting method for producing a near-net strip with a thickness of less than 40 mm.

20. The method in accordance with claim 11, wherein the at least one adjustable profiling roll deforms the metal strip so that a metallurgical structure of the metal strip is altered.

21. The method in accordance with claim 11, including smoothing surface waviness with a quadratic or higher-order component that develops on a surface of the metal strip with the at least one adjustable profiling roll or with at least one pair of adjustable profiling rolls.

* * * * *